US007728495B2

(12) United States Patent
Zuk et al.

(10) Patent No.: US 7,728,495 B2
(45) Date of Patent: Jun. 1, 2010

(54) HID LAMP WITH FRIT SEAL THERMAL CONTROL

(75) Inventors: Karlene J. Zuk, Danvers, MA (US); Arlene Hecker, Beverly, MA (US); Cathy S. Trumble, Barrington, NH (US); Joanne M. Browne, Newburyport, MA (US)

(73) Assignee: Osram Sylvania Inc., Danvers, MA (US)

( * ) Notice: Subject to any disclaimer, the term of this patent is extended or adjusted under 35 U.S.C. 154(b) by 525 days.

(21) Appl. No.: 11/832,032

(22) Filed: Aug. 1, 2007

(65) Prior Publication Data

US 2009/0033193 A1 Feb. 5, 2009

(51) Int. Cl.
*H01J 1/02* (2006.01)

(52) U.S. Cl. ..... 313/43; 313/42; 313/623

(58) Field of Classification Search ..... 313/623, 313/627–643, 567, 111–117, 25–27, 318.01–318.09, 313/42–47, 153–162, 11, 23; 439/615, 739; 445/24, 26, 29, 22

See application file for complete search history.

(56) References Cited

U.S. PATENT DOCUMENTS 3,355,613 A * 11/1967 Dayton et al. ..... 313/40
3,936,686 A * 2/1976 Moore ..... 313/36
3,989,970 A * 11/1976 Downing ..... 313/42
4,463,281 A * 7/1984 Triebel et al. ..... 313/623
4,682,071 A * 7/1987 Thorpe ..... 313/43
4,970,431 A 11/1990 Vegter et al.
5,204,578 A * 4/1993 Dever et al. ..... 313/25
5,245,246 A * 9/1993 Boland et al. ..... 313/15
5,264,759 A * 11/1993 Lewandowski et al. ..... 313/623
5,861,714 A 1/1999 Wei et al.
6,181,054 B1 * 1/2001 Levin et al. ..... 313/113
6,400,067 B1 * 6/2002 Manning et al. ..... 313/46
2002/0005695 A1 * 1/2002 Ichibakase et al. ..... 313/634
2004/0056600 A1 * 3/2004 Lapatovich et al. ..... 313/634
2007/0138961 A1 * 6/2007 Bewlay et al. ..... 313/623

FOREIGN PATENT DOCUMENTS

EP 0 506 182 9/1992

* cited by examiner

*Primary Examiner*—Peter J MacChiarolo
*Assistant Examiner*—Donald L Raleigh
(74) *Attorney, Agent, or Firm*—Robert F. Clark

(57) ABSTRACT

A method of making an HID lamp and an HID lamp that includes a ceramic envelope with a ceramic capillary, wherein the capillary has an electrode feed-through therein that is sealed inside the capillary by a frit seal that extends inside the capillary a first distance from a distal end of the capillary, and a ceramic heat sink around at least half an external diameter of the capillary, wherein the heat sink is separated from the envelope and from the distal end of the capillary and the heat sink is in thermally conductive contact with the capillary and has an external diameter at least 1.5 times the external diameter of the capillary. In one preferred embodiment, the heat sink does not overlap the frit seal.

19 Claims, 4 Drawing Sheets

HID LAMP WITH FRIT SEAL THERMAL CONTROL

BACKGROUND OF THE INVENTION

The present invention is directed to a high intensity discharge (HID) lamp, and more particularly a ceramic metal halide (HCI) lamp, that offers better control of the temperature of the frit seal.

Ceramic lamp envelopes (also referred to as arc tubes or discharge vessels), such as those composed of polycrystalline alumina, are designed to operate at specific wattages that result in unique temperature profiles at varying locations along the ceramic envelope. The arc chamber of an HCI lamp has a specialized salt fill, gas composition, and pressure and is designed to operate at a specified wattage to result in specific lumens per watt, color temperature and color rendering index (CRI). These attributes depend on the operating temperature of the arc chamber. If the arc chamber is too cool, some of the salts can condense, which affects the luminous flux, color temperature and CRI. Alternatively, arc chambers that are too hot can degrade the frit seal between the electrode system and the ceramic envelope, particularly when the frit is in contact with corrosive metal halide fills. This can result in degradation or failure of the lamp.

In HCI lamps, the frit seal is at an end of a longitudinally extended hollow ceramic capillary through which an electrode protrudes into the arc chamber. The frit seal seals the space inside the capillary between a metal electrode feedthrough and the interior ceramic wall of the capillary. A typical frit material used to seal ceramic envelopes is $Dy_2O_3$—$S_iO_2$—$Al_2O_3$.

One approach to solving the problem of the degrading frit seal is to replace the frit seal with another sealing structure, so that the lamp is "frit-less." U.S. Pat. No. 5,861,714 (Wei et al.) discloses a HID lamp with a seal for the electrode feedthrough that does not include a frit. With reference to FIG. 1, the envelope includes a translucent ceramic tube 41 having first and second ends 42, non-conducting cermet end plugs 46 closing each of the first and second ends, and metal electrode feedthroughs 48 passing through the cermet end plugs. The cermet end plugs 46 have a multipart structure, where each plug has at least four axially aligned parts 46*a-e* with different coefficients of thermal expansion. In the embodiment shown in FIG. 1, the temperature load is reduced by moving the plugs a distance from the hot arc chamber of the lamp at the ends of ceramic capillaries 45. Separating the end plug from the arc chamber with the capillary reduces the temperature of the end plug by about 200° C. A gas tight connection between the capillary and the plug may be achieved with a bushing 47 surrounding the contact zone between the capillary 45 and the plug 46. The bushing 47 sealingly holds (clamps) the plug 46 to the end of the capillary 45. Wei et al. indicate that a frit may be applied to the outer surface of plug 46, but only to further amend the gas-tightness of the seal not as the seal itself.

Nevertheless, it is still desirable in many lamps to use a frit seal and the present invention offers better control of the temperature of the frit seal.

SUMMARY OF THE INVENTION

An object of the present invention is to provide a novel structure and method for controlling a temperature of a frit seal in which one or more partially or fully circumferential cylindrical sleeves, rings, and/or coils are placed at a preferred location or locations on a capillary to act as a heat sink to thereby adjust the thermal energy flow.

A further object of the present invention is to provide a novel lamp that includes a ceramic envelope with a ceramic capillary, wherein the capillary has an electrode feed-through therein that is sealed inside the capillary with a frit seal that extends inside the capillary a first distance from a distal end of the capillary, and a ceramic heat sink around at least half an external diameter of the capillary, wherein the heat sink is separated from the envelope and from the distal end of the capillary and the heat sink is in thermally conductive contact with the capillary and has an external diameter at least 1.5 times the external diameter of the capillary. In one preferred embodiment, the heat sink does not overlap the frit seal.

A yet further object of the present invention is to provide a method of making such a lamp that includes the step of selecting a size for the ceramic heat sink and a location for the heat sink on the capillary based on a temperature profile of the envelope and capillary in order to reduce a temperature of the frit seal during operation of the lamp.

These and other objects and advantages of the invention will be apparent to those of skill in the art of the present invention after consideration of the following drawings and description of preferred embodiments.

DETAILED DESCRIPTION OF THE INVENTION

Figure 1:
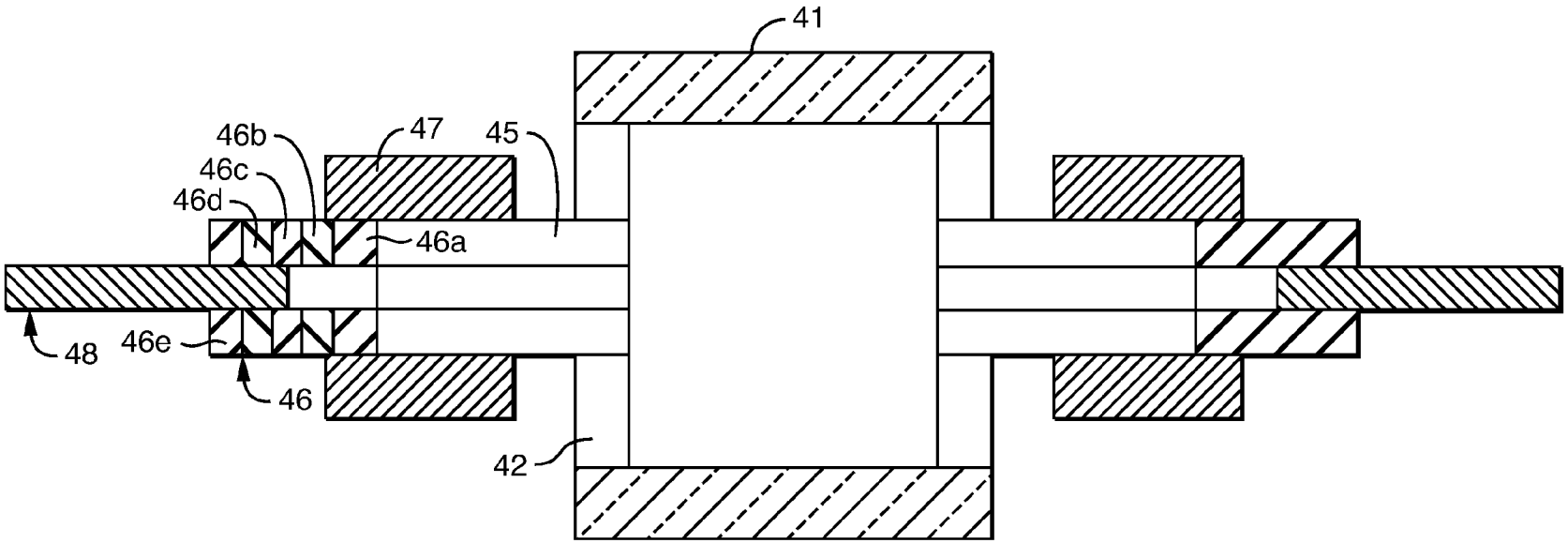
FIG. 1 (PRIOR ART)
FIG. 1 is a schematic representation of a prior art HID lamp with a bushing clamping the multipart plug to the end of the capillary.

The present invention includes one or more partially or fully circumferential cylindrical sleeves, rings, and/or coils that are placed at a selected location or locations on a capillary over or near a frit seal to act as a heat sink and adjust thermal energy flow.

The heat sink is preferably positioned on the capillary between the envelope (arc chamber) and the frit seal of a ceramic metal halide (HCI) lamp to reduce the temperature of the frit seal by conduction and preserve the integrity of the frit seal, and to expand the effective surface area of the capillary to enhance radiant and convective heat loss. The heat sink on the capillary allows the arc tube body to operate at its optimal temperature while avoiding thermal degradation of the frit seal or other sensitive areas.

The sleeve, ring, and/or coil heat sink can be designed uniquely for each lamp type with respect to thickness, area of interface, radius and composition to provide the best thermal properties for each lamp type in order to provide enough conductive and convective thermal redirection.

The sleeve, ring, and/or coil can be composed of the same or different materials as the arc tube body. The sleeve, ring, and/or coil can be designed of material with specific thermal properties unique to the specific lamp being designed. The potential use or addition of metals, oxides, nitrides, carbides, borides in the composition of the rings, coils or sleeves is encompassed in this invention.

The sleeve, ring, and/or coil can be composed of multiple materials in layers or in segments. For example, the capillary interface area of the sleeve, ring, and/or coil could be composed of a material to match the coefficient of thermal expansion of the capillary, but the outer surface can be composed of one or more different materials to further hone the desired thermal profile to be achieved. In another embodiment of this invention, the sleeve, ring, and/or coil can be tailored to enhance the thermal flow via microstructural variations.

In addition, the sleeve, ring, and/or coil can serve as a point on which automated sealing, welding, fabricating or any other automated and/or visual equipment can reference each time to enhance electrode alignment, allow plucking and placement, align the arc tube for sealing, as a welding contact point, etc.

The sleeve, ring, and/or coil heat sink added to the capillary has the advantage over coatings which can flake or peel and may be generally limited with respect to thickness, adhesion, coefficient of thermal expansion, and thermal emissivity. Furthermore, the application of a coating requires another processing step which may require masking of areas where the coating is not wanted and perhaps a vehicle or binder bake-out process.

The addition of a sleeve, ring, and/or coil heat sink to the capillary has the further advantage over thickening of the entire capillary for enhanced thermal conductivity in that the latter concept would require expensive re-tooling of current molds. Furthermore, the latter method lacks the controllability that a sleeve, ring, and/or coil heat sink has because the sleeve, ring, and/or coil is easily relocated and/or reduced and increased in contact and surface areas to achieve the desired thermal parameters. Also, computer modeling has shown that a sleeve on the capillary is much more effective at achieving the desired thermal flow adjustment than thickening the entire capillary wall.

Figure 2:
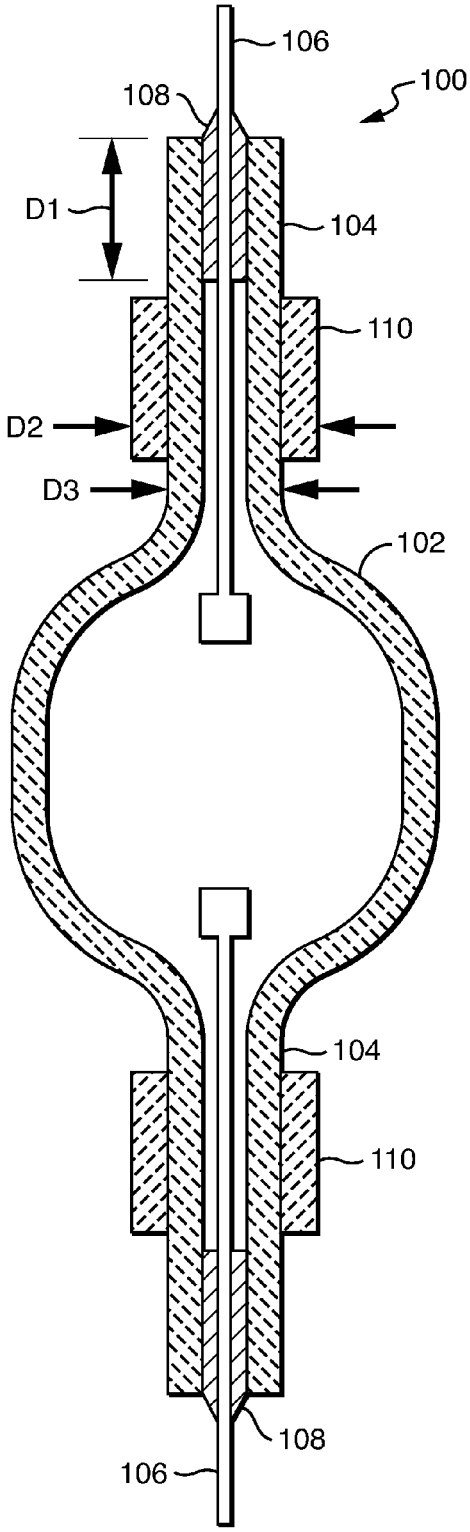
FIG. 2 is a cross section of one embodiment of the lamp of the present invention.

With reference now to FIG. 2, one embodiment of the present invention is a high intensity discharge (HID) lamp 100 that includes a ceramic envelope 102 with a ceramic capillary 104, the capillary 104 having an electrode feedthrough 106 therein that is sealed inside the capillary by a frit seal 108 that extends inside the capillary a first distance D1 from a distal end of the capillary. The lamp 100 also includes a ceramic heat sink 110 around at least half an external diameter of the capillary 104. The heat sink 110 is separated from the envelope 102 and from the distal end of the capillary 104 and is in thermally conductive contact with the capillary 104. The heat sink 110 has an external diameter D2 at least 1.5 times the external diameter D3 of the capillary 104.

As shown in FIG. 2, the heat sink 110 is separated from the distal end of the capillary 104 by more than the first distance D1 so that the heat sink does not overlap the frit seal 108. This position for the heat sink 110 reduces the temperature of the frit seal 108 by conduction and preserves the integrity of the frit seal. In an alternative embodiment shown in FIG. 3 the heat sink 110' overlaps the frit seal 108.

Figure 3:
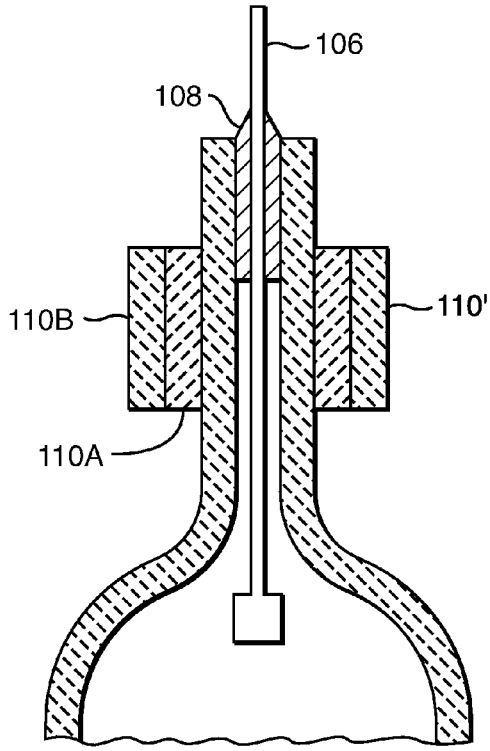
FIG. 3 is a partial cross section of a further embodiment of the lamp of the present invention.

The heat sink may extend around an entirety of the external diameter of the capillary 104, such as shown in FIGS. 2-3. This arrangement helps redirect heat from all around the frit seal area by increasing the surface area of part of the capillary. The heat sink may also serve as a thermal management device during sealing of the arc chamber, where the sealing operation remains hotter than usual due to the heat sinking/insulation provided by the heat sink, resulting in better frit flow and more consistent (better) seals as well as reduced convective heat loss by restriction of the orifice while in the narrow heating unit of the sealer.

Figure 4:
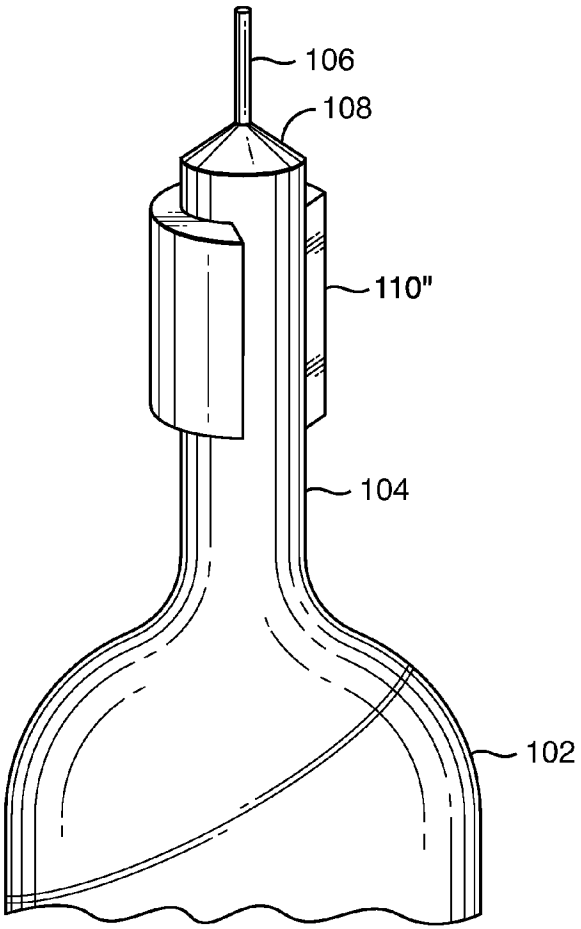
FIG. 4 is a partial pictorial representation of a further embodiment of the lamp of the present invention.

Alternatively, as shown in FIG. 4 the heat sink 110' extends only partially around the external diameter of the capillary. The partial surround embodiment may be suitable to help control a flow of the frit into the capillary, for example where one side of the frit is hotter than the other side. The partial surround embodiment also may provide a window for viewing during frit sealing.

While the size and location of the heat sink 110 depends on the thermal characteristics of the lamp and the amount of heat to be redirected by the heat sink, in one embodiment the external diameter D2 of the heat sink is at least 2 to 3 times the external diameter D3 of the capillary 104. Further, the heat sink extends 20% to 80% of a length of the capillary from the envelope 102 to the distal end of the capillary.

Figure 5:
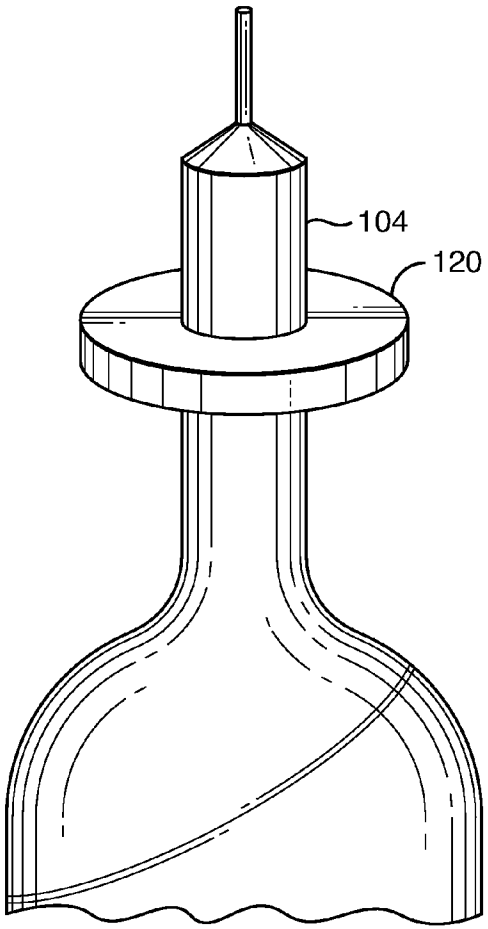
FIG. 5 is a partial pictorial representation of a yet further embodiment of the lamp of the present invention.
Figure 7:
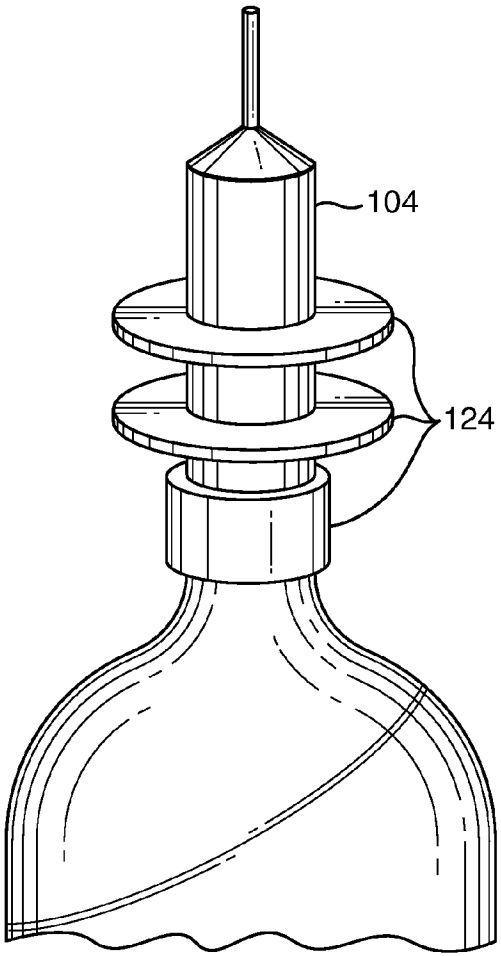
FIG. 7 is a partial pictorial representation of another embodiment of the lamp of the present invention.
Figure 6:
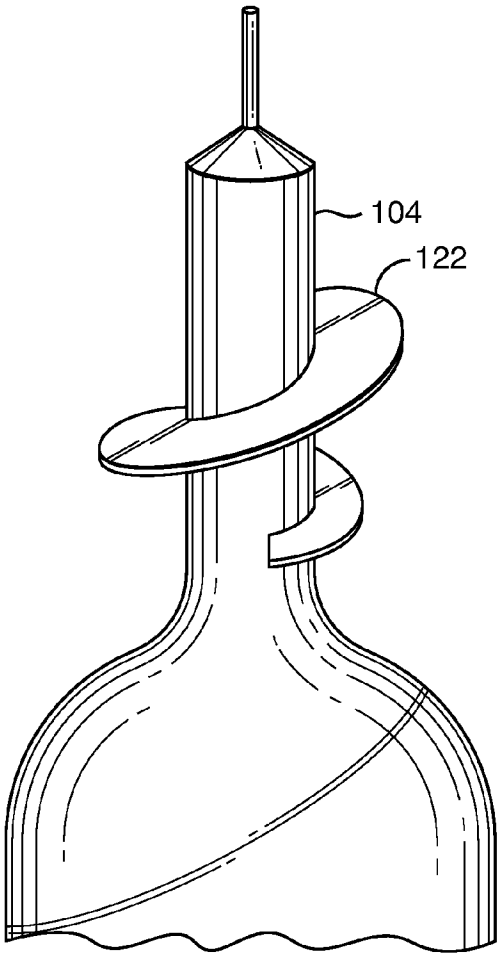
FIG. 6 is a partial pictorial representation of a still further embodiment of the lamp of the present invention.

The heat sink may take various forms, such as the sleeve shown in FIGS. 2-4 (a sleeve has a length along the capillary that is greater than the external diameter of the heat sink.) Alternatively, the heat sink may be a ring 120 as shown in FIG. 5 (a ring has a length along the capillary that is less than the external diameter of the heat sink) or a coil 122 as shown in FIG. 6. More than one heat sink of the same or different configurations may be provided on a capillary as shown in FIG. 7 in which the heat sinks 124 are separated from each other along the capillary 104.

The heat sink may be provided on only one capillary or on each capillary in the lamp. Some lamps are intended to operate with the longitudinal axis held vertically and in such lamps the "upper" capillary gets hotter and thus may benefit more from the heat sink than the "lower" capillary.

The heat sink may made of a same material as the capillary and be integral therewith. Alternatively, the heat sink may be made of a different material than the capillary (different doping, ceramic, etc.) selected on the basis of the thermal characteristics of the lamp.

As shown in FIG. 3, the heat sink may be multilayered with an inner-most layer 110A that has a same coefficient of thermal expansion as the capillary 104 and an outer-most layer 110B that has a different coefficient of thermal expansion.

The invention also includes a method making the above-described lamp. The method includes providing a ceramic envelope 102 that has a ceramic capillary 104, sealing an electrode feedthrough 106 inside the capillary 104 with a frit seal 108 that extends inside the capillary a first distance D1 from a distal end of the capillary. The method further includes the step of selecting a size for the heat sink 110 and a location for the heat sink on the capillary 104 based on a temperature profile of the envelope 102 and capillary 104 in order to reduce a temperature of the frit seal 108 during operation of the lamp. The heat sink of the selected size is attached around at least half an external diameter of the capillary at the selected location.

The invention requires no new processing steps if the sleeve, ring, and/or coil heat sink is designed into the tool for injection molding, or potentially one additional processing step where the sleeve, ring, and/or coil is placed on the capillary before or after presintering or sintering.

One or many ceramic sleeves, rings, and/or coils can be added to the ceramic monolith during or after arc tube formation, and before or after presintering or sintering to provide an intimate thermal contact on the capillary or other arc tube area, and optionally become part of the monolith. The thickness, surface area, overall dimensions and arc tube interface area of the heat sink can be altered to achieve optimal thermal characteristics to allow optimal lamp performance. The sleeve, ring, and/or coil can be arranged at a location or locations along the capillary to provide the optimal thermal properties for each specific lamp type.

The sleeve, ring, and/or coils may be added after sintering and adhered to the arc tube with adhesive cement or by shrink-fitting. Alternatively, the sleeve, ring, and/or coil may be prepared with ceramic powder and a suitable binder and fitted on to the capillary in the green state, then presintered to remove the binder and fasten the sleeve, ring, and/or coil through a shrinkage-fitting, then sintered. Pre-calculation of the shrinkage parameters of the ceramic pieces is required. In another embodiment, the mold is altered to allow the heat sink to be present after injection molding.

The effectiveness of the heat sink of the present invention has been tested. In the test, vertically oriented test lamps similar to that shown in FIG. 2 (with "upper" and "lower" capillaries) were compared to similarly oriented control lamps without the heat sink. The frit seal in each lamp extended about 4 to 5 mm from the distal end of the capillary (D1 in FIG. 2). The heat sink in the test lamps was placed so that it did not overlap the frit seal (separated by about 1 mm from the frit seal). The results show that the heat sink in the test lamps decreased the temperature at the frit seal in the "upper" capillary by about 23° C. compared to the control lamps (from an average of 743.8° C. to 719.4° C.). The "upper" capillary was about 20° C. hotter than the "lower" capillary. Further, the arc tube body temperature was not significantly affected by the addition of the heat sink (although the body temperature near the "lower" capillary was a bit cooler than the control).

While embodiments of the present invention have been described in the foregoing specification and drawings, it is to be understood that the present invention is defined by the following claims when read in light of the specification and drawings.

We claim:

1. A high intensity discharge lamp, comprising:

a ceramic envelope with a ceramic capillary, said capillary having an electrode feed-through therein that is sealed inside said capillary by a frit seal that extends inside said capillary a first distance from a distal end of said capillary; and a ceramic heat sink around at least half an external diameter of said capillary, said heat sink being separated from said envelope and from said distal end of said capillary, said heat sink being in thermally conductive contact with said capillary and having an external diameter at least 1.5 times the external diameter of said capillary.

2. The lamp of claim 1, wherein said heat sink is separated from said distal end of said capillary by more than the first distance so that said heat sink does not overlap said frit seal.

3. The lamp of claim 1, wherein said heat sink overlaps a portion of said frit seal.

4. The lamp of claim 1, wherein said heat sink extends around an entirety of the external diameter of said capillary.

5. The lamp of claim 1, wherein said heat sink extends only partially around the external diameter of said capillary.

6. The lamp of claim 1, wherein the external diameter of said heat sink is 2 to 3 times the external diameter of said capillary.

7. The lamp of claim 1, wherein said heat sink extends 20% to 80% of a length of said capillary from said envelope to said distal end.

8. The lamp of claim 1, wherein said heat sink is a sleeve that has a length along said capillary that is greater than the external diameter of said heat sink.

9. The lamp of claim 1, wherein said heat sink is a ring that has a length along said capillary that is less than the external diameter of said heat sink.

10. The lamp of claim 1, wherein said heat sink is a coil wound around said capillary.

11. The lamp of claim 1, further comprising more than one said heat sink, which are separated from each other along said capillary.

12. The lamp of claim 1, wherein said heat sink is made of a same material as said capillary and is integral therewith.

13. The lamp of claim 1, wherein said heat sink is multi-layered with an inner-most layer that has a same coefficient of thermal expansion as said capillary and an outer-most layer that has a different coefficient of thermal expansion.

14. A method of making a high intensity discharge lamp, comprising the steps of:

providing a ceramic envelope that has a ceramic capillary;

sealing an electrode feedthrough inside said capillary with a frit seal that extends inside said capillary a first distance from a distal end of said capillary;

selecting a size for a ceramic heat sink and a location for said heat sink on said capillary based on a temperature profile of said envelope and said capillary in order to reduce a temperature of said frit seal during operation of the lamp; and attaching said heat sink of the selected size around at least half an external diameter of said capillary at the selected location, said heat sink being separated from said envelope and from said distal end of said capillary, said heat sink being in thermally conductive contact with said capillary and having an external diameter at least 1.5 times the external diameter of said capillary.

15. The method of claim 14, wherein the selected location for said heat sink is more than the first distance so that said heat sink does not overlap said frit seal.

16. The method of claim 14, wherein the selected size for said heat sink is annular so that said heat sink extends around an entirety of the external diameter of said capillary.

17. The method of claim 14, further comprising the step of attaching more than one said heat sink, which are separated from each other along said capillary.

18. The method of claim 14, wherein said heat sink is fitted onto said capillary in a green state, presintered to remove a binder, and then sintered to attach said heat sink to said capillary in said attaching step.

19. The method of claim 14, wherein said envelope, capillary, heat sink are made of a same material and molded at a same time from a common mold in said providing and attaching steps.

* * * * *